United States Patent [19]

Keith

[11] Patent Number: 4,811,939

[45] Date of Patent: Mar. 14, 1989

[54] PRINTING PLATFORM

[75] Inventor: Malcolm E. Keith, West Chicago, Ill.

[73] Assignee: Midaco Corporation, Elk Grove Village, Ill.

[21] Appl. No.: 88,591

[22] Filed: Aug. 24, 1987

[51] Int. Cl.[4] ..... B65H 1/18

[52] U.S. Cl. ..... 271/146; 271/148; 271/155; 271/171; 271/227

[58] Field of Search ..... 271/146, 148, 152, 154, 271/155, 171, 227

[56] References Cited

U.S. PATENT DOCUMENTS 4,432,539 2/1984 Fischer ..... 271/146 X
4,635,924 1/1987 Pollich ..... 271/227

FOREIGN PATENT DOCUMENTS 145042 7/1986 Japan ..... 271/155

*Primary Examiner*—Richard A. Schacher
*Attorney, Agent, or Firm*—Hill, Van Santen, Steadman & Simpson

[57] ABSTRACT

A platform for supporting paper and/or cardboard which is to be supplied to a printing press wherein the sheets of paper are stacked on a inner table which is mounted in an outer table for adjustable movement and wherein the outer table is driven vertically so as to lift and automatically feed the paper to a printing press or other machine and wherein the paper can be aligned in a first direction by jogging it against bars fixed to the printing press to align first edges and wherein a sensor senses the lateral position of the upper edges of the sheets of paper and controls an adjusting motor which adjusts the position of the inner table so that the lateral position of the upper sheets being fed to the printing press or at the proper position.

9 Claims, 5 Drawing Sheets

PRINTING PLATFORM

BACKGROUND OF THE INVENTION

1. Field of the Invention

This invention relates in general to a moveable table for feeding paper or cardboard to a printing press and in particular to an improved printing platform.

2. Description of the Prior Art

In printing presses, paper is fed vertically wherein the top sheet is removed as required for printing and the alignment of such sheets must be such that they are picked up by the printing press feed system at the proper location so they will align with the printing machine. It has been known in the prior art to jog the stack of paper sheets so as to align one edge. However, often times the lateral edges of the paper stack are not straight or aligned with the feed mechanism and this causes jamming of the paper and/or misalignment of the printing due to such lateral misalignment.

SUMMARY OF THE INVENTION

It is an object of the present invention to provide a moveable platform for a printing press or other machine wherein paper or cardboard is to be stacked and fed to a machine in which the paper can be aligned in a first orientation by jogging it to place all of the edges in a first direction so that they fall in a vertical plane and which has a sensor placed adjacent the lateral edge of the top sheet which is to be next fed to the printing press which produces a signal that indicates whether the sheet is at the right position. If the sheet is too far away from the sensor or too close to the sensor polarized signals are produced which drive a positioning motor which adjusts the position of the top sheets by moving the platform upon which the paper is stacked. The platform is attached to an inner table that is moveable relative to an outer support table by a motor which is driven by the output of the sensor.

It is an object of the present invention to provide a moveable platform for a printing press wherein the sheets to be printed are maintained in the proper alignment.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 2:
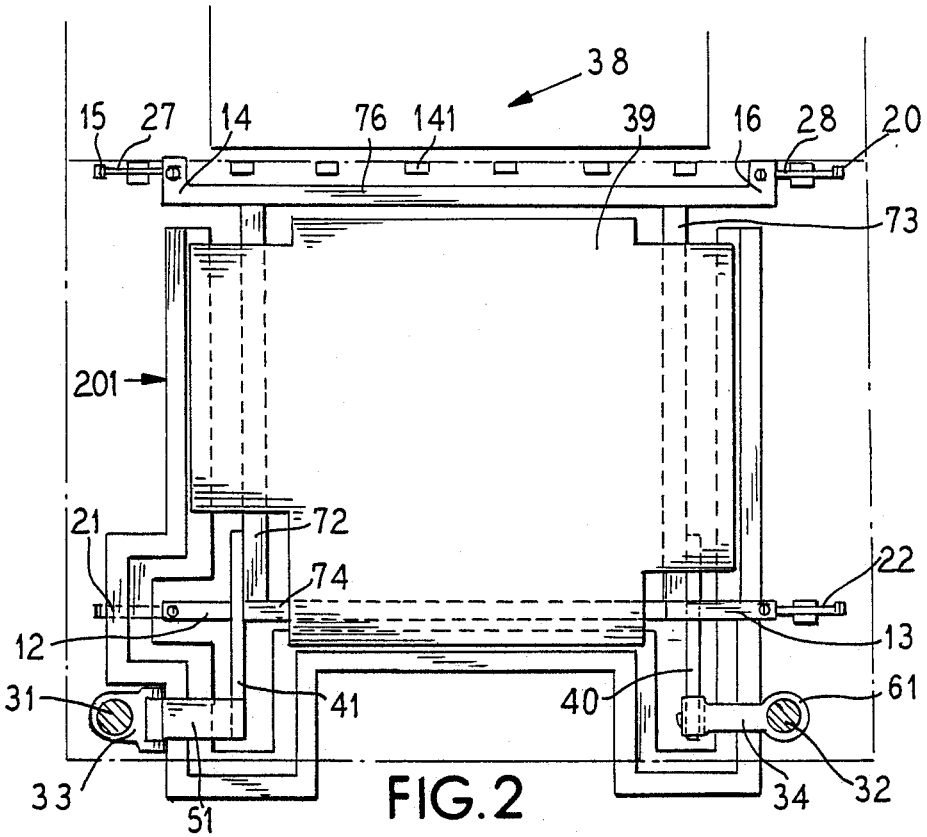
FIG. 2 is a top plan view of the moveable platform of the invention.
Figure 3:
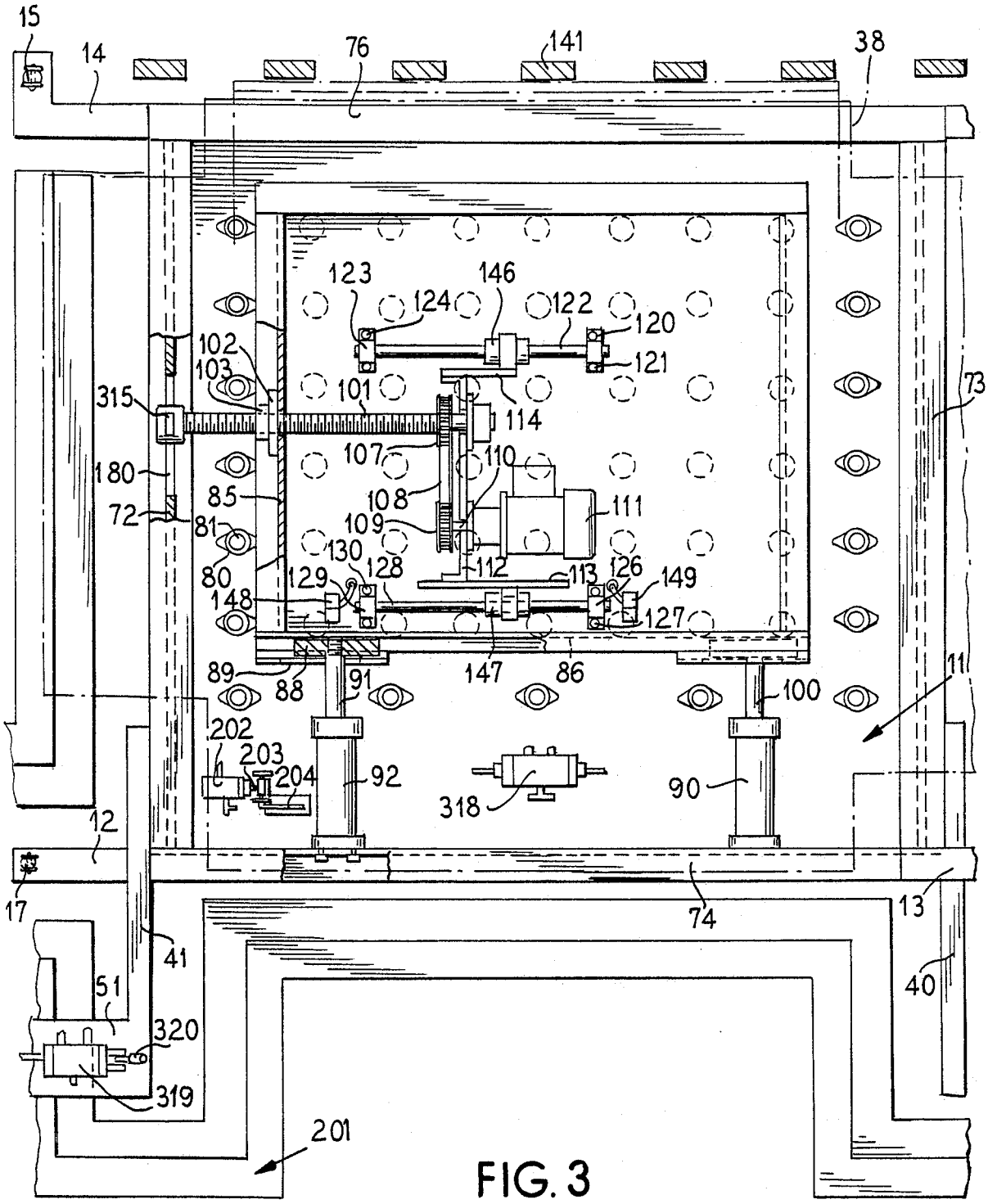
FIG. 3 is an enlarged partially cut-away top plan view of the moveable platform of the invention.
Figure 4:
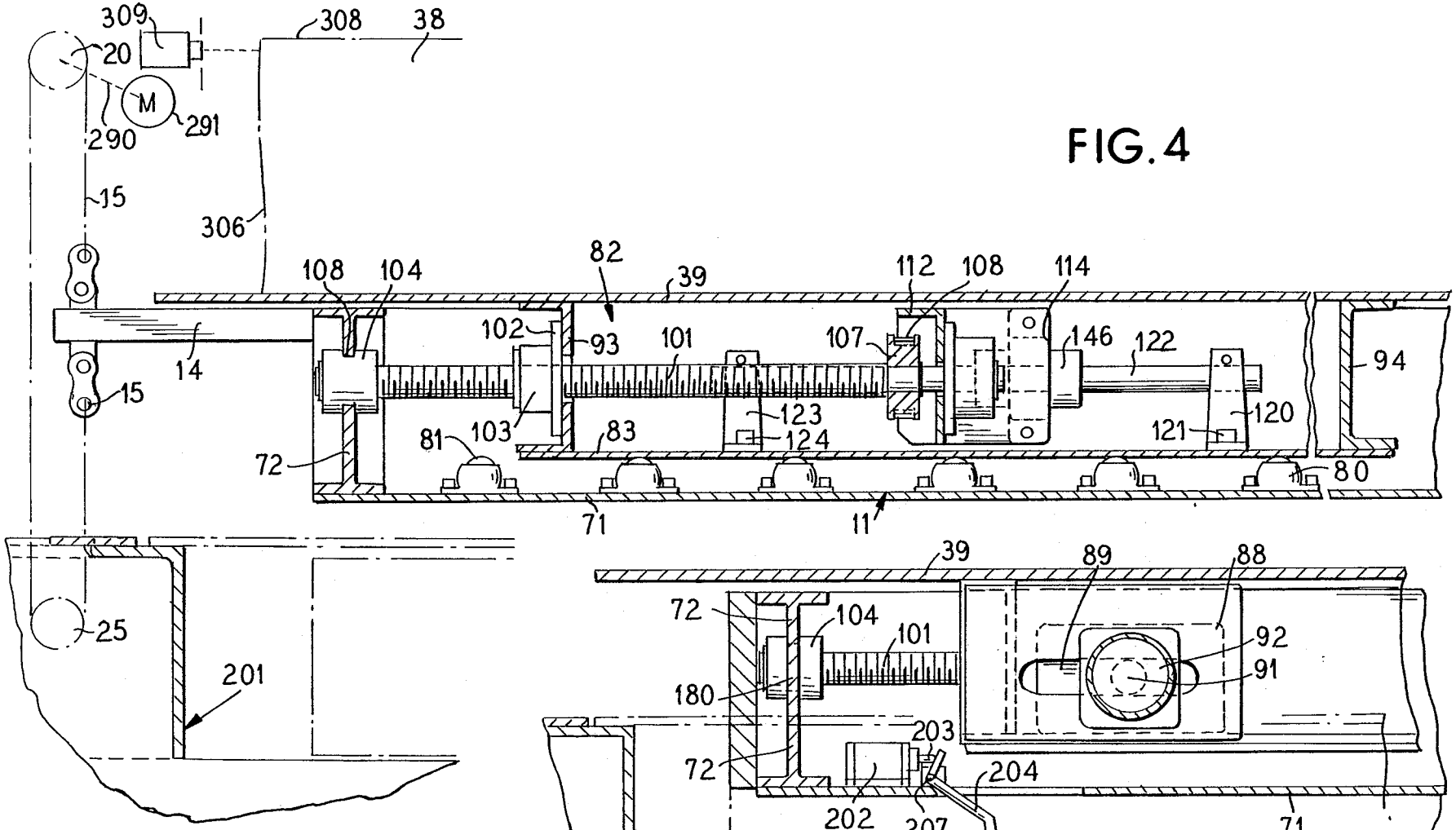
FIG. 4 is a sectional view taken on line IV—IV in FIG. 3.
Figure 5:
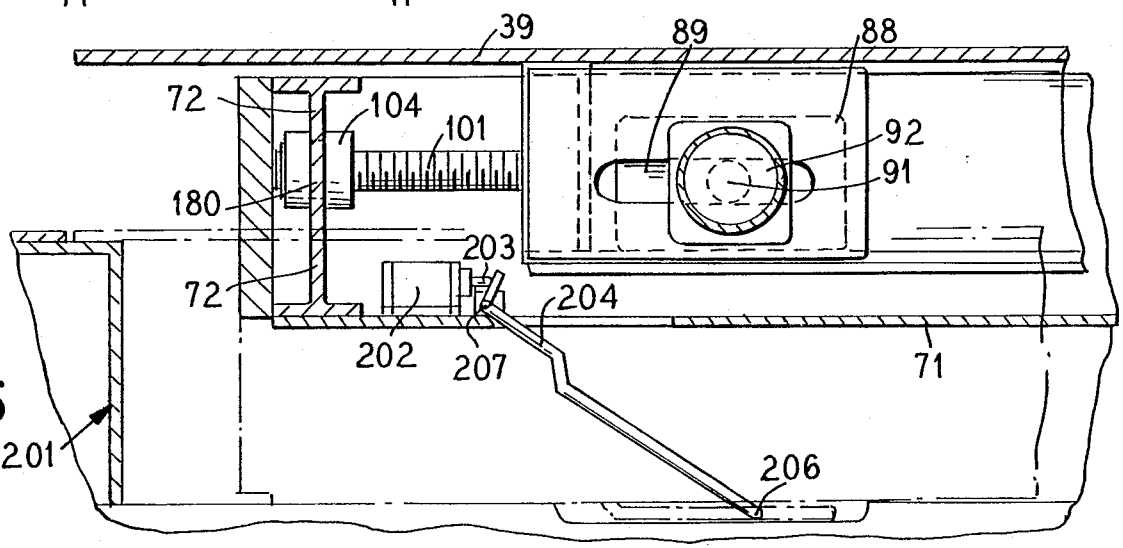
FIG. 5 is a detail view illustrating the feeler arm and centering mechanism.
Figure 6:
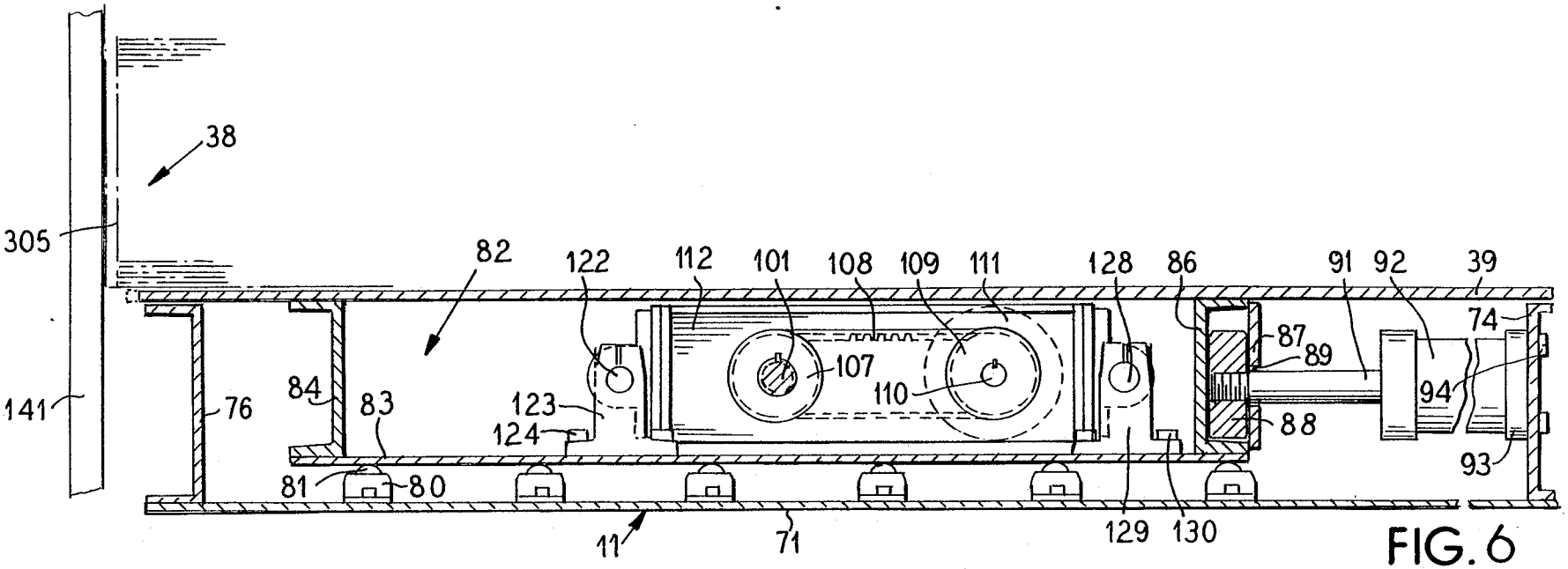
FIG. 6 is a sectional view disclosing the drive motor for moving the inner table.

FIGS. 1-6 illustrate the printing platform of the invention which includes a composite table comprising an outer table 11 which carries an inner table 82 which is moveable laterally relative to the outer table. The table supports stacked paper 38 shown in FIG. 1. The paper 38 is supported on a cover plate 39 which is attached to the tops of the vertical walls 84 and 86 and 93 and 94 of the inner table 82. The inner table has a bottom 83 as illustrated in FIGS. 4 and 6 which is moveably supported by ball supports 81 mounted in retainers 80. The ball supports 81 and retainers 80 are conventional commercially available units and are mounted on the bottom 71 of the outer table 11. The outer table 11 has sidewalls 72, 73, 74 and 76 as shown.

The composite table comprising the inner table 82 and the outer table 11 can be moved vertically by means including guide shafts 31 and 32 which are mounted adjacent the table on either side thereof and are embedded into the floor where the moveable platform is to be mounted. The guide shafts 31 and 32 pass through guide members 33 and 34 which are attached by arms 34 and 51 to the arms 40 and 41 which are connected to the outer table 11 as shown, for example, in FIGS. 2 and 3.

Figure 1:
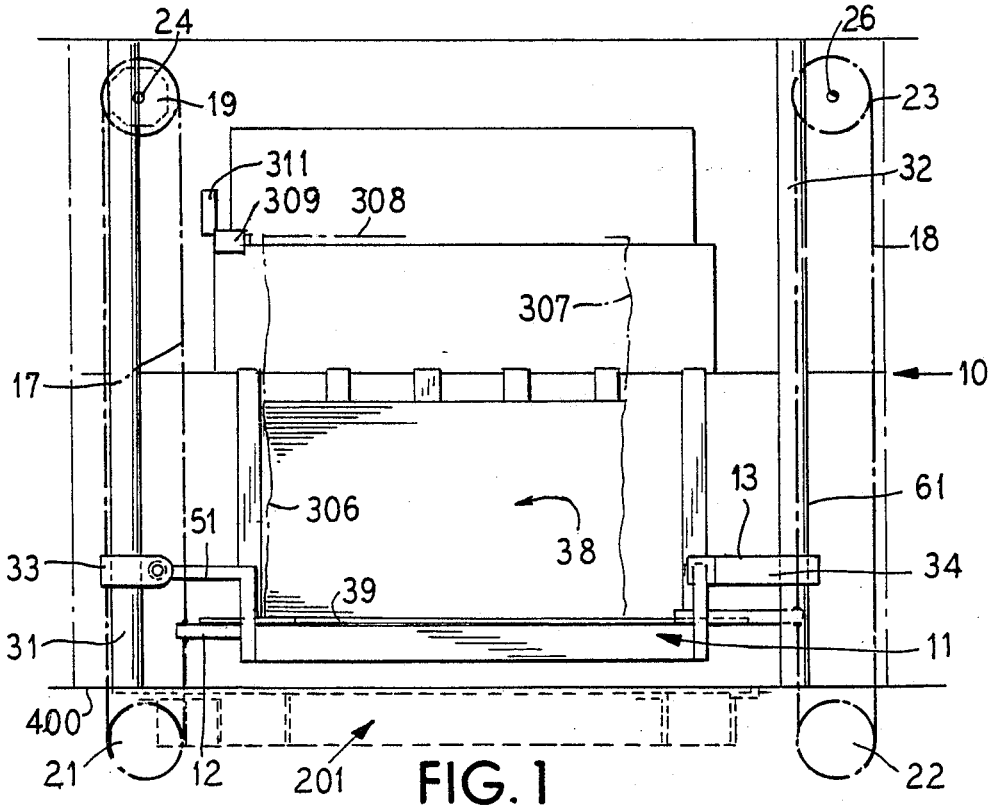
FIG. 1 is a side plan view of the moveable platform of the invention.

Vertical driving means are provided so as to lift the composite platform and includes arms 12, 13, 14 and 16 which are attached adjacent the four corners of the outer table 11 as shown in FIGS. 1, 2 and 4. Each of the arms 12, 13, 14 and 16 are respectively connected to drive chains for lifting the moveable platform and, thus, so as to raise the paper 38. For example, the arm 12 has its outer end connected to a chain 17 which passes over vertically spaced sprockets 19 and 21 carried on shafts such as the shaft 24. Likewise the other arms 13, 14 and 16 are respectively connected to chains. For example, the arm 13 is connected to an endless chain 18 which passes over drive sprockets 22 and 23 which are vertically spaced from each other and as shown, the sprocket 23 is mounted on a support shaft 26. A drive chain 15 is connected to the arm 14 as shown in FIGS. 2, 3 and 4 and the chain 15 passes over vertically spaced sprockets 20 and 25. The sprocket 19 is driven by a shaft 250 which is driven by a motor 251 as shown in FIG. 4. It is to be realized that each of the endless chains which are connected to the arms 12, 13, 14 and 16 are driven by suitable driving means as, for example, the same motor 251 so as to assure that the various corners of the platform rise and fall at the same rate.

The moveable platform including the outer table 11 and the inner table 82 are moveable on the guides 31 and 32 from a position wherein the top cover 39 is flush with the floor 400 so that paper can be easily placed on the cover 39 with a lift truck, for example. As shown in FIGS. 1, 2, 3, 4 and 5, an outer frame member 201 is mounted in the floor and the inner and outer tables are moveable into such frame member 201 so that the top cover plate 39 is flush with the floor. As shown in top view 3 and sectional side view 6, the inner table 82 can be jogged in a left to right motion relative to FIG. 6 so that the front edges 305 of the stack of papers 39 will engage a plurality of vertically mounted alignment rods 141 which are connected to the ground or the frame of the printing machine so as to align the edges 305 of the paper 38. A pair of cylinders 90 and 92 have their base ends connected to the vertical wall 74 of the outer table 11 as shown in FIGS. 3 and 6 and, for example, the cylinder 92 has a base portion 93 which is connected by bolts 94 to the wall 74. The piston shaft 91 of the piston 92 is connected to a slide member 88 which is held against the vertical wall 86 of the inner table 82 by a partition 87 as shown in FIG. 6 which is formed with a groove 89 so as to allow the inner table to move to the left and right relative to FIG. 3. The cylinder 90 also has a piston shaft 100 which is connected to a slide similar to slide 88 which is mounted against the wall 86. When the cylinders 90 and 92 are energized, simultaneously but intermittently, the inner table 82 and paper 38 is jogged against the vertical alignment bars 141 so as to align the edge 305 of the paper.

The inventor has discovered that it is also necessary to align the side edges of the stack of paper 38 so as to assure that the printing press feed mechanism which removes the paper from the top of the stack 38 mounted on cover 39 is aligned. This is the edge 306 illustrated, for example, in FIG. 1 which as shown is not aligned but is irregular such that the sidewalls 306 and 307 illustrated in FIG. 1 are not straight vertical lines but meander due to the misalignment of the paper. So as to assure that the top sheet 308 of the paper 38 is aligned relative to the left to right direction of FIG. 1, a sensor 309 is mounted to the frame of the machine adjacent the upper layer 308 of the paper 38 on the sidewall 306 where the paper is removed to the printing press. The sensor 309 is a commercially available unit which may be a Honeywell type 93553V-003-N which is accurate to one-quarter inch and has an input of 11.5 to 16 volts DC 250 milliamps and an output of 30 volts DC 100 milliamps maximum. The sensor 309 provides an output to a motor 111 which drives in opposite directions so as to move the inner table 82 to the left and right relative to FIGS. 1, 3 and 4 such that the distance between the sensor 309 and the edge of the upper sheet 308 is maintained. The motor 111 is mounted on a bracket 112 which is carried on arms 113 and 114 which carry guide brackets 146 and 147 as shown in FIG. 3. Horizontally mounted guide shafts 122 and 128 pass through the brackets 146 and 147, respectively. The shaft 122 is supported by brackets 121 and 123 connected to its opposite ends and which are connected by suitable bolts 120 and 124 to the floor 83 of the inner table 82. The shaft 128 has its opposite ends mounted in brackets 126 and 129 which are respectively connected to the floor 83 of the inner table 82 by bolts 127 and 130. The output shaft 110 of the motor 111 carries a sprocket 109 which drives a belt 108 which passes around sprocket 107 nonrotatably mounted on a shaft 101 which has one end rotatably supported in the bracket 112.

The shaft 101 is threaded and passes through a collar 102 and nut 103 which are attached to the wall 85 of the inner table 82. The end of threaded shaft 101 extends from wall 85 to a retainer means 315 connected to the end of the shaft 101 which is mounted in a slot 180 formed in end wall 72 of the outer table 11.

Limit switches 148 and 149 are mounted at opposite ends of guide shaft 128 and are engageable by the arm 113 such that when the table 82 moves to its limits, the limit switches 148 and 149 will be respectively actuated.

When the sensor 309 detects that the upper sheet 308 is either too far away or too near it, it produces a signal which causes the motor 111 to drive the shaft 101 which rotates relative to the collar 101 and the nut 103 which are attached to the wall 85 of the inner table 82 thus moving the inner table 82 to the left or right relative to FIG. 3. As the table moves to the left or right, the motor 111 moves on the brackets 146 and 147 to the left and right on the guide shafts 122 and 128.

Figure 7:
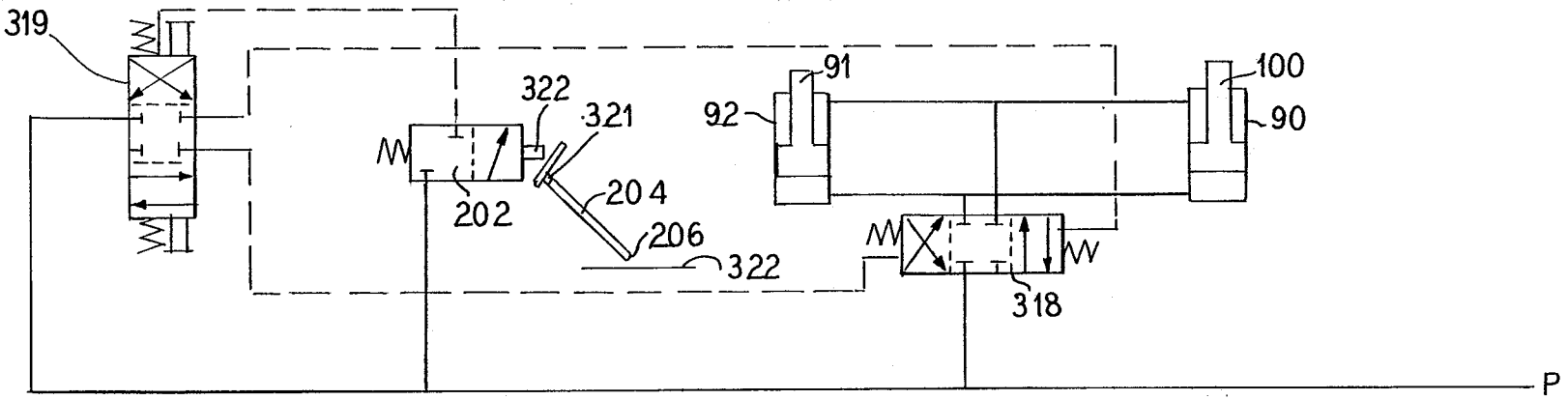
FIG. 7 is a schematic view of the hydraulic drive system.

The hydraulic system for operating the cylinders 90 and 92 is shown in FIG. 7. The cylinders 90 and 92 are connected to a valve 318 which is connected to an operating valve 319 such that when the hand operated valve 319 is opened and closed, the cylinders 90 and 92 will be energized so as to move the pistons 91 and 100, thus jogging the inner table 92 against the alignment bars 141 so as to align the edge 305 of the paper 38 in the vertical direction. The valve 319 has a handle 320 as illustrated in FIG. 3 so as to allow it to be manually actuated to jog the inner table 82 for alignment the paper. Also, so as to assure that the support plate 39 of the inner table 82 are centered so that the composite table can move into the confines of the outer frame 201, a feeler arm 204 which has an end 206 is pivotably mounted on a shaft 321 mounted to the outer table 11 and when the platform is lowered, the end 206 engages the bottom of the floor 322 to actuate a hydraulic valve 202 by depressing its actuating plunger 322 which is connected to valve 319 so as to center the inner table 82.

Figure 8:
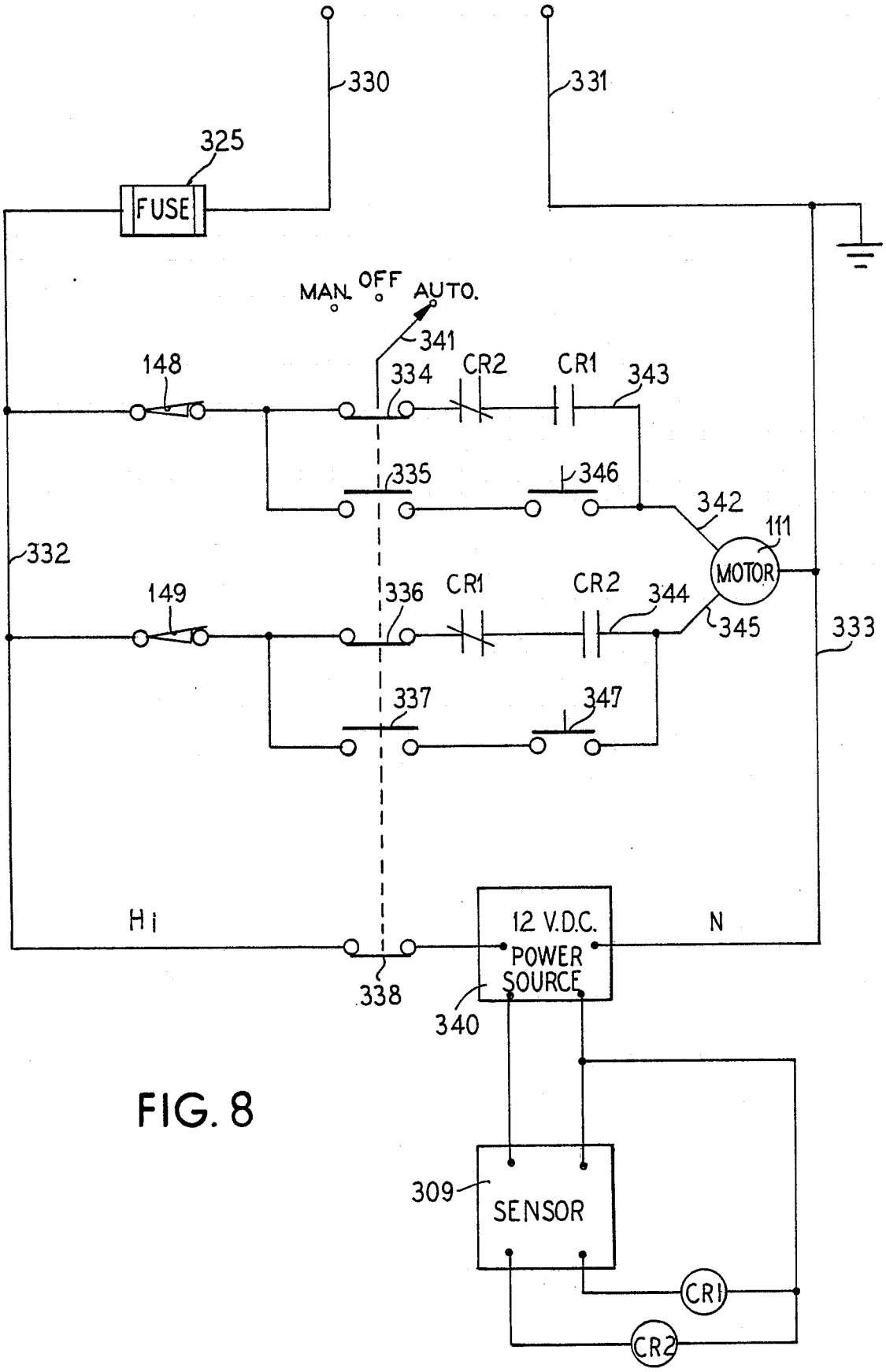
FIG. 8 is an electrical schematic of the control system.

FIG. 8 illustrates the electrical schematic and illustrates power lines 330 and 331 which are connected to a suitable 120 volt source. Line 330 is connected through a fuse 325 to line 332. The left limit switch 148 has one side connected to line 332. The sensor 309 receives an input from a 12 volt power source 340 and selectively operates a move left relay CR1 or a move right relay CR2. The relay CR1 may be energized, for example, if the upper edge of the paper is too close to the sensor 309 and the relay CR2 may be energized if it is too far from the sensor 309. A switch 341 is moveable to the auto, off or manual position and in the auto position has contacts 334 which complete the circuit from the limit switch 148 to the normally closed contacts of relay CR2 which is connected to one side 342 of the motor 111 through the normally opened contacts of the relay CR1. If the paper is too close, sensor 309 energizes relay CR1 which closes the normally opened contacts CR1 to energize the motor 111 in the first direction to move the inner table 82 to the left relative to FIG. 1. If on the other hand, the sensor detects that the edge of the paper is too far from the sensor, the relay CR2 will be energized, thus closing contacts 344 which are in series with normally closed contacts CR1 and power will be supplied from lead 332 through limit switch 149, switch 336 normally closed contacts CR1 and closed contacts CR2-344 to the input lead 345 of motor 111 so that it operates in the opposite direction thus moving the inner table to the right relative to FIG. 1. In the manual position of switch 341, the contacts 334 and 336 are opened and the switches 335 and 337 are closed so that manual jog lift switch 346 can be energized to move the table to the left or, alternatively, the manual switch 347 can be closed to move the table to the right.

It is seen that this invention provides a novel self-aligning support table.

Although it has been described with respect to preferred embodiments, it is not to be so limited as changes and modifications may be made therein which are within the full intended scope as defined by the appended claims.

I claim as my invention:

1. A composite table for supporting sheets for a machine comprising, an outer table, vertically extending guide means slidably connected to said outer table to guide it in the vertical direction, lifting means connected to said outer table to selectively move it up or down, an inner table mounted to said outer table so as to be moveable relative thereto, a cover plate attached to said inner table, a jogging cylinder mounted between said outer and inner table, a plurality of sheets mounted on said cover plate, means for actuating said jogging cylinder, vertically extending aligning means mounted adjacent said cover plate such that said plurality of sheets engage said aligning means when said jogging cylinder is energized so as to align first edges of said sheets, a distance sensor mounted so as to sense the position of the top sheet and to produce control signals to move said inner table relative to said outer table at right angles to the direction of movement of said jogging cylinder, a motor means connected to receive the output of said distance sensor and an actuating means connected to said motor means, said inner table, and said outer table such that the position of the top sheet is positioned such that the distance between said distance sensor and said top sheet is maintained constant.

2. A composite table according to claim 1 wherein retainers are mounted in said outer table and balls are rotatably mounted in said retainers and said inner table is formed with a bottom which rests on said balls so that said inner table can be moved relative to said outer table.

3. A composite table according to claim 1 wherein said means for actuating said jogging cylinder comprises a manual valve which supplies fluid to said jogging cylinder.

4. A composite table according to claim 3 including a second jogging cylinder mounted between said outer and said inner table and connected to said means for actuating said jogging cylinder.

5. A composite table according to claim 4 wherein said jogging cylinder and said second jogging cylinder are mounted to said inner or outer tables so that motion at right angles to the direction of movement of said jogging cylinders can occur.

6. A composite table according to claim 1 wherein said actuating means includes a lead screw with one end attached to said outer table and a threaded collar on said inner table through which said lead screw is attached and said motor means connected to said lead screw.

7. A composite table according to claim 6, a pair of guides mounted to said inner table with one on either side of said motor means, and a bracket attached to said motor and with a pair of openings through said pair of guides extend.

8. A composite table according to claim 1 wherein said lifting means includes a second motor means, a pair of vertically spaced pulleys, an endless belt mounted on said spaced pulleys and attached to said outer table and said second motor means connected to drive one of said spaced pulleys.

9. A composite table according to claim 1 including a feeler arm connected to said outer table to detect when said composite table is near its bottom position and connected to said means for actuating said jogging cylinder to center said inner table.

* * * * *